US008800461B2

(12) United States Patent
Gagan, II

(10) Patent No.: US 8,800,461 B2
(45) Date of Patent: Aug. 12, 2014

(54) BOAT SEPARATOR USEFUL FOR SEPARATING BOATS WITH WAKEBOARD RACKS

(76) Inventor: James Lawrence Gagan, II, Valparaiso, IN (US)

( * ) Notice: Subject to any disclaimer, the term of this patent is extended or adjusted under 35 U.S.C. 154(b) by 0 days.

(21) Appl. No.: 13/462,954

(22) Filed: May 3, 2012

(65) Prior Publication Data

US 2012/0279435 A1 Nov. 8, 2012

Related U.S. Application Data

(60) Provisional application No. 61/482,017, filed on May 3, 2011.

(51) Int. Cl.
*E02B 3/24* (2006.01)

(52) U.S. Cl.
USPC ..... 114/230.17; 114/230.15; 114/230.16; 114/230.18; 114/230.19

(58) Field of Classification Search
USPC ..... 114/230.15–230.18
See application file for complete search history.

(56) References Cited

U.S. PATENT DOCUMENTS

| | | | | | |
|---|---|---|---|---|---|
| 3,863,591 | A * | 2/1975 | Wild | 114/230.26 |
| 4,686,926 | A * | 8/1987 | Vance | 114/230.18 |
| 4,817,551 | A * | 4/1989 | Matson | 114/230.15 |
| 5,357,891 | A * | 10/1994 | Kobayashi et al. | 114/242 |
| 5,398,634 | A * | 3/1995 | Eagan | 114/230.1 |
| 5,450,808 | A * | 9/1995 | Beagan | 114/230.18 |
| 5,499,591 | A * | 3/1996 | Chippas | 114/230.15 |
| 5,676,085 | A * | 10/1997 | Michl, Jr. | 114/230.1 |
| 6,851,380 | B1 * | 2/2005 | Khoury et al. | 114/230.15 |
| 7,089,877 | B1 * | 8/2006 | Hay | 114/230.17 |
| 7,100,527 | B2 * | 9/2006 | Munro | 114/230.15 |
| 7,418,913 | B2 * | 9/2008 | Dowd | 114/230.17 |
| 7,637,222 | B1 * | 12/2009 | Keely | 114/230.17 |
| 7,827,924 | B1 * | 11/2010 | Perez | 114/230.15 |
| 8,091,499 | B1 * | 1/2012 | Perez | 114/230.15 |

* cited by examiner

*Primary Examiner* — Lars A Olson
*Assistant Examiner* — Jovon Hayes
(74) *Attorney, Agent, or Firm* — McDonnell Boehnen Hulbert & Berghoff LLP

(57) ABSTRACT

A boat separator comprising a boat extender having a first cross member attached to a first end of the boat extender, and a second cross member attached to the second end of the boat extender. The boat separator preferably has an adjustable length such that the boat extender can be extended between 20 and 30 inches.

25 Claims, 5 Drawing Sheets

BOAT SEPARATOR USEFUL FOR SEPARATING BOATS WITH WAKEBOARD RACKS

RELATED APPLICATIONS

This patent application claims priority to U.S. Provisional Patent Application Ser. No. 61/482,017, entitled "Boat Separator Useful for Separating Boats with Wakeboard Racks," filed on May 3, 2011, the entire contents of which are fully incorporated herein by reference as if fully set forth herein.

FIELD

This patent application is directed to the field of boating. In particular, this patent application is directed to a device and/or method for separating boats from one another when they are tied up.

BACKGROUND

Recreational boaters often tie their boats together, or "tie-up" with other boaters to socialize or to take a break from boating activities such as waterskiing or wakeboarding. Boats are typically tied together via ropes where a rope attached to one boat is thrown to the other boat and is attached to a cleat or other securing device. Sometimes, a rubber bumper(s) is placed between two boats that have tied up to prevent them from bumping into each other and potentially damaging each other.

Recently, wakeboarding has become a popular pastime for boaters. Wakeboard boats typically include a wakeboard tower that is used to tie a rope from the wakeboard tower that extends to the wakeboarder pulled by the wakeboard boat. Wakeboard boats often include wakeboard racks located on one or both sides of the wakeboard tower that are used to stow the wakeboards when they are not being used. A difficulty arises when a wakeboard boat with a wakeboard rack seeks to tie up with another boat, as often the wakeboard rack may rub against and potentially deface or damage the paint or fiberglass of the boat that it ties up with. The problem is exacerbated when two wakeboard boats having wakeboard racks seek to tie up with each other. Often, even when using a rubber bumper, the wakeboard racks may extend from the side of the boat to such an extent that the wakeboard racks bump into each other or into the other boat, potentially damaging the paint or fiberglass of the other boat.

Thus, there is a need to provide a device that can be used to separate a wakeboard boat from another boat that it is tied up with to prevent the wakeboard rack from bumping into and potentially damaging the other boat. More particularly, there is a need to provide a device that can be used to separate two boats having wakeboard racks that are tied up to one another.

SUMMARY

The present embodiments comprise a boat separator that is designed to minimize and/or eliminate the bumping that is caused between boats that are tied up where one or more of the boats includes a wakeboard rack. The boat separator preferably comprises a boat extender having a first cross member attached to a first end of the boat extender. The boat separator may also include a second cross member attached to a second end of the boat extender. The first cross member has a width that is adapted to be placed between respective wakeboard support members of a wakeboard rack. Thus, the width of the first cross member should be small enough to fit within a gap formed between two wakeboard support members of a wakeboard rack. This width is preferably less than 2¾" which is slightly larger than the thickness of a typical wakeboard. It should be noted that the width of the first cross member does not need to be of a uniform width, and could be wider in the middle than it is at the ends or vice versa. The first cross member also should have a length that is adapted to be long enough so that the ends of the first cross member extend beyond the length of the wakeboard support members. The length of typical wakeboard support members is around 12 to 13 inches. Therefore, the length of the first cross member preferably has a length of 14 inches or more.

BRIEF DESCRIPTION OF THE DRAWINGS

Exemplary embodiments are described herein with reference to the drawings wherein.

DETAILED DESCRIPTION

Figure 1:
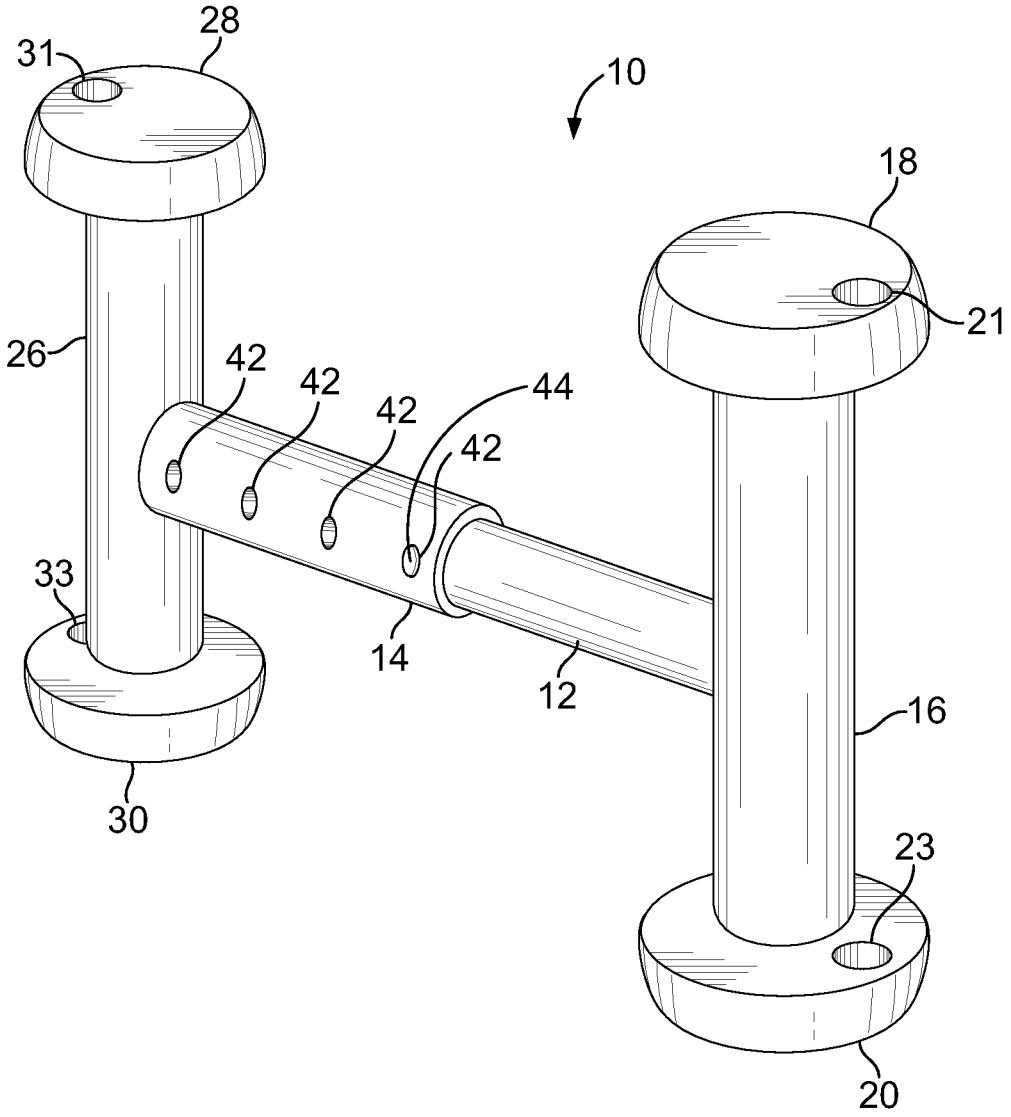
FIG. 1 is a perspective view of a boat separator having an adjustable length boat extender.

FIG. 1 shows a perspective view of boat separator 10. Boat separator 10 is shown with boat extender 12 and first cross member 16. Although not required, boat separator 10 is also shown with boat extender length adjuster 14 shown with various holes 44 located along an outer surface and adapted to mate with a spring biased detent button 44. In this manner, the length adjuster 14 may be used to shorten or lengthen the length of the boat extender 12 as desired. In addition, to insure that both ends of the first cross member 16 always extend beyond the outer ends of the wakeboard support members, it is desirable to include a stop at both ends of the first cross member. Stops 18 and 20 are shown on each end of cross member 16. The stops 18 and 20 serve to prevent the first cross member from slipping too far longitudinally and prevent either end of the first cross member 16 from slipping inside of the outer ends of the wakeboard support members. The stops 18 and 20 can be in the form of a disc, ball, square or other geometry, and can be any other configuration suitable to serve as a stop. In any event, it is preferable that the stops 18 and 20 extend beyond the width of the boat extender at its end by at least one inch.

The first cross member 16 has a width that is adapted to be placed between respective wakeboard support members of a wakeboard rack. Thus, the width of the first cross member 16 should be small enough to fit within a gap formed between two wakeboard support members of a wakeboard rack. This width is preferably less than 2¾" which is slightly larger than the thickness of a typical wakeboard. It should be noted that the width of the first cross member 16 does not need to be of a uniform width, and could be wider in the middle than it is at the ends or vice versa. The first cross member 16 also should have a length that is adapted to be long enough so that the ends of the first cross member 26 extend beyond the length of the spacing of the wakeboard support members. The length of the spacing between typical wakeboard support members is around 12 to 13 inches. Therefore, the length of the first cross member 16 preferably has a length of 14 inches or more.

In an embodiment of the boat separator 10 that includes a first cross member 16 at one end of the boat extender 12 and a second cross member 26 at the other end of the boat extender 12, the second cross member 26 may be, but does not have to be, constructed in a manner similar to the first cross member 16. For example, the second cross member may have a width that is adapted to be placed between respective wakeboard support members of a wakeboard rack. Thus, the width of the second cross member 26 should be small enough to fit within a gap formed between two wakeboard support members of a wakeboard rack. This width is preferably less than 2¾" which is slightly larger than the thickness of a typical wakeboard. It should be noted that the width of the second cross member 26 does not need to be of a uniform width, and could be wider in the middle than it is at the ends or vice versa. The second cross member 26 also should have a length that is adapted to be long enough so that the ends of the second cross member 26 extend beyond the length of the wakeboard support members. The length of typical wakeboard support members is around 12 to 13 inches. Therefore, the length of the second cross member 26 preferably has a length of 14 inches or more.

In addition, to insure that both ends of the second cross member 26 always extend beyond the outer ends of the wakeboard support members, it is desirable to include a stop at the both ends of the second cross member 26. Stops 28 and 30 are shown on the ends of second cross member 26. The stops 28 and 30 serve to prevent the second cross member 26 from slipping too far longitudinally and prevent either end of the first cross member from slipping inside of the outer ends of the wakeboard support members. The stops 28 and 30 can be in the form of a disc, ball, square or other geometry, and can be any other configuration suitable to serve as a stop. In any event, it is preferable that the stops 28 and 30 extend beyond the width of the boat extender at its end by at least one inch. As noted below, stops internal to the lateral spacing of the wakeboard support members could also be used.

Moreover, in some instances it is desirable to include holes in the stops that are adapted to receive the end of a bungee cord. As shown in FIG. 1 stop 18 includes a hole 21 that a rope or cord, such as a bungee cord, may be attached to. Similarly, stop 20 is shown with a hole 23, stop 28 is shown with a hole 31, and stop 30 is shown with a hole 33. A rope or cord can be used to help secure a wakeboard to the wakeboard supports, or to secure the cross members 16 or 26 of the boat separator 10 to the respective wakeboard supports or wakeboard tower.

Figure 2:
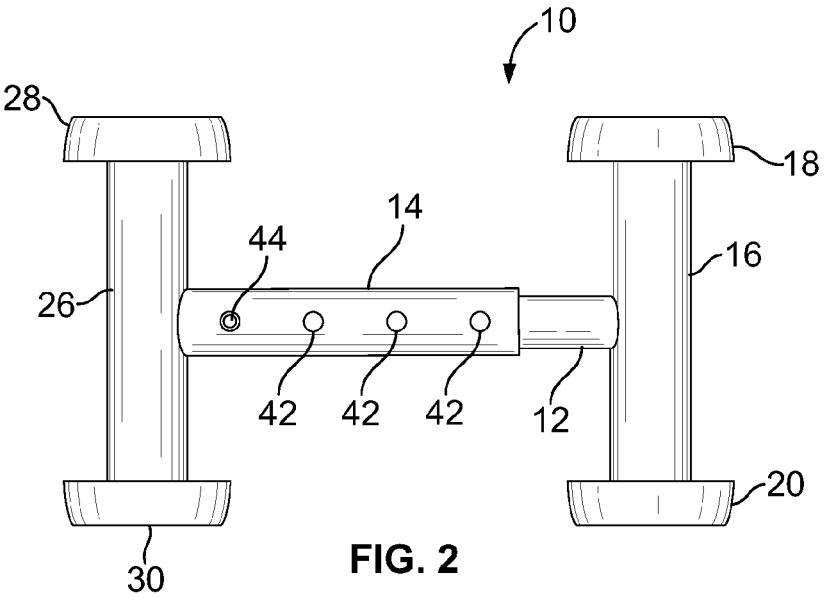
FIG. 2 is a front view of the boat separator of FIG. 1 shown with the boat extender in a retracted position.

Further, often wakeboard boats of varying sizes may want to tie up with each other. To accommodate the varying heights of the wakeboard racks, the varying distances they extend from their respective boats, the different sizes of the boats, etc., it is desirable to have a boat separator that has an adjustable length boat extender to allow the boat separator to be used with a variety of boat combinations. FIG. 2 shows a front view of boat separator 10 having a boat extender 12 positioned between first cross member 16 and second cross member 26. In FIG. 2, the optional boat extender length adjuster 14 is shown in a most retracted state. With spring biased detent button 44 shown positioned in the hole 42 closest to the second cross member 26.

Figure 3:
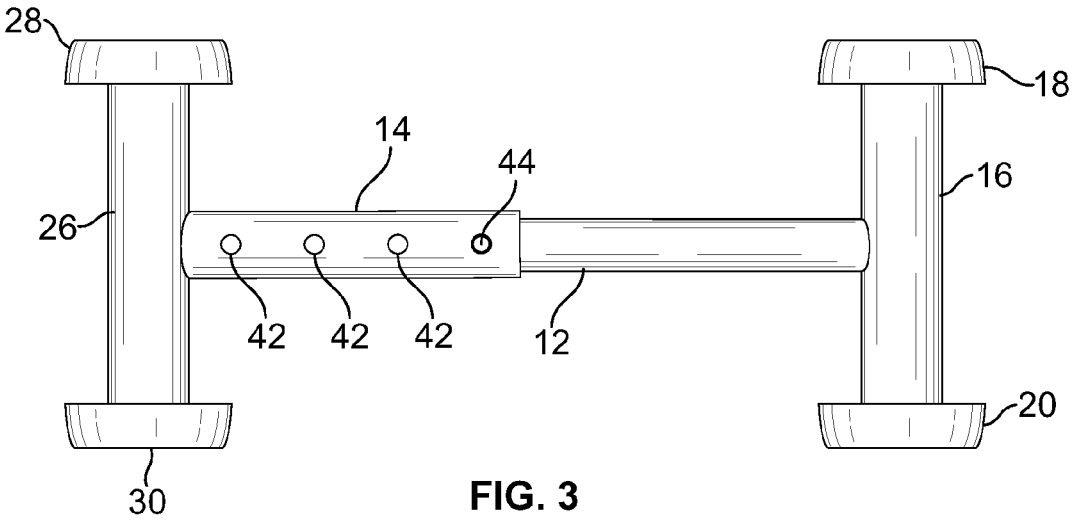
FIG. 3 is a front view of the boat separator of FIG. 1 shown with the boat extender in an extended position.

In FIG. 3, the optional boat extender length adjuster 14 is shown in a most extended state with spring biased detent button 44 shown positioned in the hole 42 closest to the first cross member 16. Ideally, the boat extender should allow a span of between 20 to 30 inches between the first cross member and the second cross member to accommodate a sufficient number of boat combinations. Thus, the distance between the first cross member 16 and second cross member 26 in FIG. 2 is preferably around 18-20 inches in the most retracted state, and the distance between the first cross member 16 and second cross member 26 in FIG. 3 is preferably around 30-36 inches in its most extended state. While a spring biased detent button is shown, the length of the boat extender 12 can be adjusted in any number of different ways that allow for the boat extender 12 to be of varying lengths.

For example, it may be telescoping with spring actuated detents, or use the spring detents extension system often used adjustable length with door jambs, or crutches. It also could have holes that line up for cotter pins to be inserted therethrough. It could also include threaded connectors that screw into each other to change the length. It could also be a compression fitting like a paint pole might have. The manner of length adjustment is not critical at all and any suitable means for adjusting the length of the boat extender may be used.

It will be appreciated that the cross-section of the boat extender 12, first cross member 16, and second cross member 26 may vary. For example, the cross-section could be square, circular, oval, rectangular, or other geometric form defined or undefined. Preferably, the cross-section of these elements is circular. The length of the boat separator 10 is preferably 18-36 inches. Also, the cross members do not have to be, but are preferably perpendicular to the boat extender.

The boat extender and cross members may be formed of plastic, metal, composites, or other suitable material. The cross members can be attached to each other using any suitable means of attachment, including by welding the cross members to the ends of the boat extender, securing them via bolts, by integrally molding them together, screwing them together, etc.

Figure 4:
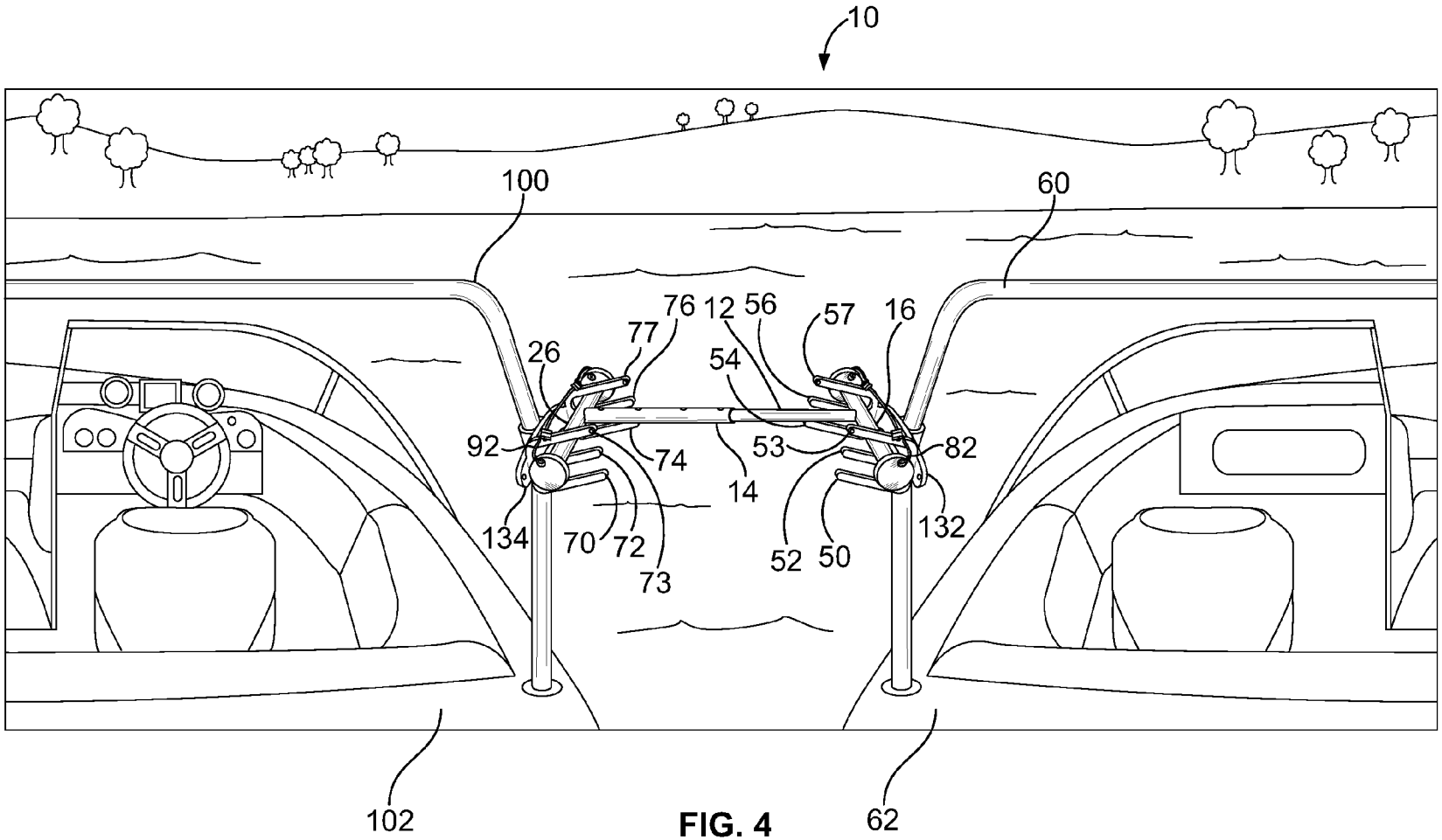
FIG. 4 is a perspective view of two boats separated by the boat extender shown in FIG. 1.

FIG. 4 is a perspective view of boat 102 and boat 62 separated by boat separator 10. The first cross member 16 is shown attached to boat extender 12, with the first cross member 16 positioned within wakeboard support members 53 and 52, and wakeboard support members 57 and 56 positioned on wakeboard rack 132 positioned on wakeboard tower 60 on boat 62. As can be seen, the length of the cross member 16 is greater than the distance between wakeboard support member 57 and wakeboard support member 53, and the stops 18 and 20 (see FIG. 1) are shown extending outside of the wakeboard support members arms to prevent the first cross member 16 from slipping out of the wakeboard support members. Also shown is a cord 82 that holds the first cross member 16 in place in the wakeboard support members, and also serves to prevent the first cross member 16 from coming out of the wakeboard rack 132.

Similarly, the second cross member 26 is shown attached to boat extender length adjuster 14, with the second cross member 26 positioned within wakeboard support members 73 and 72, and wakeboard support members 77 and 76 positioned on wakeboard rack 134 positioned on wakeboard tower 100 on boat 102. As can be seen, the length of the second cross member 26 is greater than the distance between wakeboard support member 77 and wakeboard support member 73, and the stops 28 and 30 (see FIG. 1) are shown extending outside of the wakeboard support members to prevent the second cross member 26 from slipping out of the wakeboard support members. Also shown is a cord 92 that holds the second cross member 26 in place in the wakeboard support members, and also serves to prevent the second cross member from coming out of the wakeboard rack 134. In this manner, the boat separator 10 serves to maintain a distance between boat 62 and boat 102 and help to prevent damage to either of the boats by keeping them advantageously separated.

Figure 5:
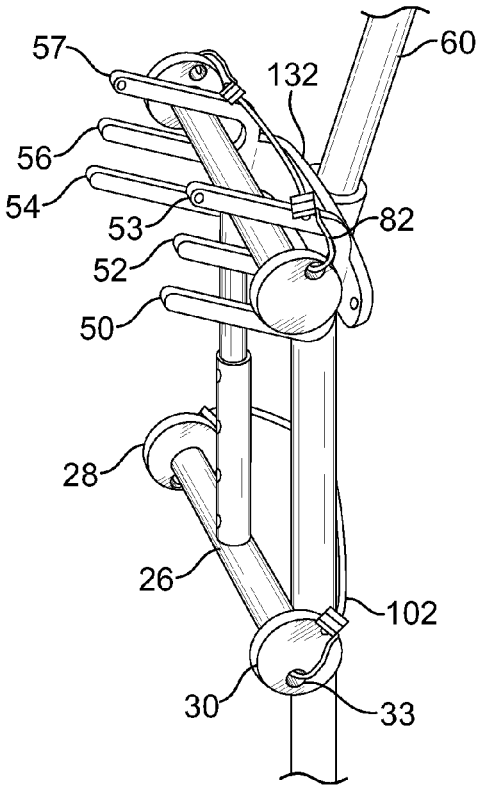
FIG. 5 is a perspective view of the boat extender of FIG. 1 shown stowed on a wakeboard tower.

FIG. 5 shows a close perspective view of the boat separator stored on the wakeboard rack 132 when it is not being used. The wakeboard rack 132 is positioned on wakeboard tower 60. The first cross member of the boat separator is shown positioned between wakeboard support members 53 and 52, and wakeboard support members 57 and 56. The first cross member is held in place by cord 82. Similarly, the second cross member 26 is secured to the wakeboard tower 60 by cord 102. Once it is desired to tie up to another boat, the boat separator is at the ready, simply by unsecuring cord 102, as the first cross member is already in position between the wakeboard support members. Thus, the boat separator has the ability to be quickly deployed, and can be located on the wakeboard tower so that it won't get misplaced or tucked away in a storage space in the boat. It will be appreciated that while the Figures show stops positioned outside of the wakeboard support members, it is also possible to provide one or more stops that prevent the cross members from slipping through the wakeboard support members by using stops that are positioned inside of the wakeboard support members. For example, the width of the first cross member in between the wakeboard support members 53 and 57 could be dimensioned to be larger than the spacing between wakeboard support members 57 and 56 and larger than the spacing between wakeboard support members 53 and 52.

Figure 6:
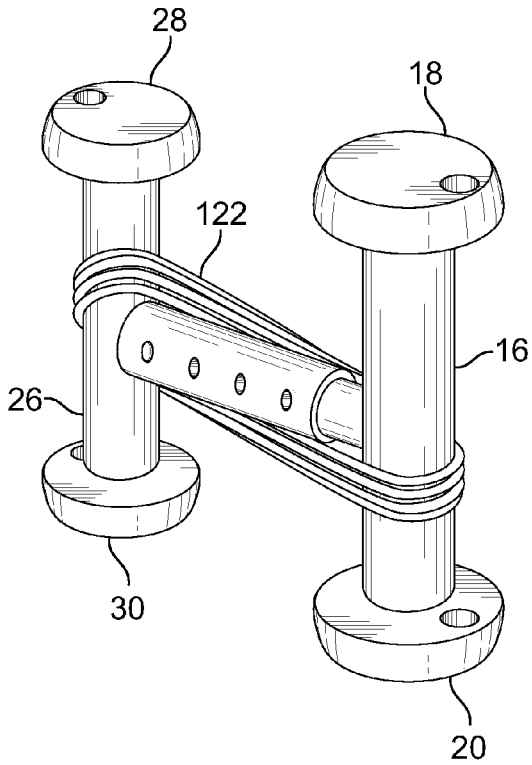
FIG. 6 is a perspective view of the boat extender of FIG. 1 being used to store a tow rope.

Furthermore, FIG. 6 shows the boat separator being used to store a tow rope 122. Boats, and particularly wakeboard boats, often have a number of different ropes, e.g. a waterski rope, a wakeboard rope, an anchor rope, etc. It is important to keep the ropes properly wound up to prevent the ropes from tangling with one another. The boat separator, as shown in FIG. 6, may serve as a place to wind up a tow rope to keep the boat tidy and prevent ropes from tangling. To wind up rope 122, the rope is alternately wound over first cross member 16 and second cross member 26, and the stops 18 and 20, and 28 and 30 prevent the rope from sliding off.

Figure 7:
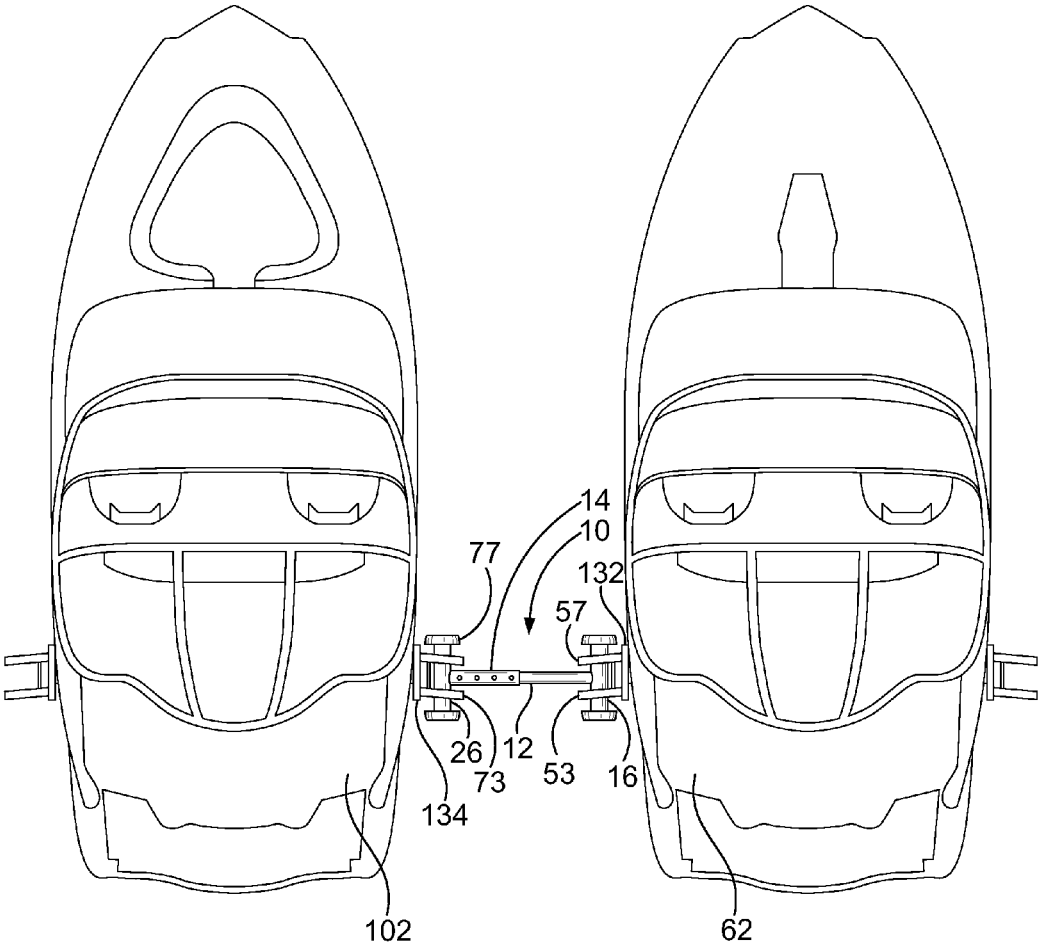
FIG. 7 is a top view of two boats separated by the boat extender shown in FIG. 1.

FIG. 7, is a top view of boat 62 and boat 102 separated by boat separator 10 as they are "tied up." First cross member 16 is shown positioned in wakeboard rack 132 beneath wakeboard support members 53 and 57 on boat 62, and second cross member 26 is shown positioned in wakeboard rack 134 beneath wakeboard support members 73 and 77 on boat 102.

Example embodiments of the present invention have been described above. Those skilled in the art will understand that changes and modifications may be made to the described embodiments without departing from the true scope and spirit of the present invention, which is defined by the claims.

I claim:

1. A boat separator comprising:

a boat extender having a first cross member attached to a first end of the boat extender, and a second cross member attached to the second end of the boat extender, wherein the first cross member has a length of 14 inches or more and is positionable within wakeboard support members that are separated from each other by a distance of 2¾ inches;

wherein a stop is positioned at each end of the first cross member.

2. The boat separator of claim 1, wherein the boat extender has an adjustable length.

3. The boat separator of claim 2, wherein the boat extender has an adjustable length such that the boat extender can be extended between 20 and 30 inches.

4. The boat separator of claim 1, means for securing the first cross member within wakeboard support members that are separated from each other by a distance of 2¾ inches.

5. The boat separator of claim 4, wherein the second cross member has a length of 14 inches or more and further including means for securing the second cross member within wakeboard support members that are separated from each other by a distance of 2¾ inches.

6. The boat separator of claim 5, wherein a stop is positioned at each end of the second cross member.

7. The boat separator of claim 6, wherein each stop includes a hole adapted to receive an end of a bungee cord.

8. The boat separator of claim 1, further including means for maintaining a position of a first end of the first cross member and a position of a second end of the first cross member outside of a first end of the wakeboard support members and a second end of the wakeboard support members.

9. The boat separator of claim 1, further including a means for extending the length of the boat extender.

10. A boat separator comprising:

a boat extender having a first cross member attached to a first end of the boat extender, wherein the first cross member has a length of 14 inches or more; wherein the first cross member is positionable within wakeboard support members, and at least a portion of the cross member has a width that is smaller than the spacing between wakeboard support members.

11. The boat separator of claim 10, further including means for adjusting the length of the boat extender.

12. The boat separator of claim 10, wherein the boat extender has an adjustable length such that the boat extender can be extended between 20 and 30 inches.

13. The boat separator of claim 10, wherein at least a portion of the width of the first cross member is smaller than the spacing between wakeboard support members that are spaced apart 2¾ inches.

14. The boat separator of claim 10, wherein a stop is positioned at each end of the first cross member.

15. The boat separator of claim 10, further including a second cross member attached to a second end of the boat extender.

16. The boat separator of claim 15, wherein a stop is positioned at each end of the second cross member.

17. The boat separator of claim 14, wherein each stop includes a hole for securing a bungee cord to a wakeboard support member.

18. The boat separator of claim 16, wherein each stop includes a hole for securing a bungee cord to a wakeboard support member.

19. The boat separator of claim 10, wherein at least a portion of the width of the first cross member is less than 2¾ inches.

20. The boat separator of claim 19, and further including means for securing the first cross member within wakeboard support members that are separated from each other by a distance of 2¾ inches.

21. The boat separator of claim 10, further including means for maintaining a position of a first end of the first cross member outside of a first end of the wakeboard support members and a second end of the wakeboard support members.

22. The boat separator of claim 21, wherein a width of at least a portion of the first cross member is less than 2¾ inches.

23. A method of separating a first boat having a wakeboard rack from a second boat, comprising the steps of:

providing a boat separator having a boat extender and a first cross member attached to a first end of the boat extender, wherein the first cross member has a length of 14 inches or more; and wherein at least a portion of the first cross member has a width that is smaller than the spacing between wakeboard support members on the wakeboard rack on the first boat;

positioning the first cross member on the wakeboard rack on the first boat; and positioning a second end of the boat extender on the second boat.

24. The method of claim 23, wherein at least a portion of the width of the first cross member has a width that is 2¾ inches or less.

25. The method of claim 23, wherein a second cross member is attached to the second end of the boat extender, wherein the first cross member has a length of 14 inches or more; and wherein at least a portion of the second cross member has a width that is smaller than the spacing between wakeboard support members on a wakeboard rack on the second boat, further comprising the steps of:

positioning the second cross member on the wakeboard rack on the second boat;

securing the first cross member to the wakeboard rack on the first boat; and securing the second cross member to the wakeboard rack on the second boat.

* * * * *